US011452351B2

(12) United States Patent
Kibe et al.

(10) Patent No.: US 11,452,351 B2
(45) Date of Patent: Sep. 27, 2022

(54) HAIR HOLDER, METHOD FOR PRODUCING SAID HAIR HOLDER, AND METHOD FOR USING SAID HAIR HOLDER

(71) Applicant: Kao Corporation, Tokyo (JP)

(72) Inventors: Yoshiyuki Kibe, Utsunomiya (JP); Takehiko Tojo, Utsunomiya (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 17/421,159

(22) PCT Filed: Feb. 1, 2019

(86) PCT No.: PCT/JP2019/003541
§ 371 (c)(1),
(2) Date: Jul. 7, 2021

(87) PCT Pub. No.: WO2020/157947
PCT Pub. Date: Aug. 6, 2020

(65) Prior Publication Data

US 2022/0039531 A1 Feb. 10, 2022

(51) Int. Cl.
*A45D 2/00* (2006.01)
*A45D 2/18* (2006.01)
(Continued)

(52) U.S. Cl.
CPC ..... *A45D 2/18* (2013.01); *A45D 6/04* (2013.01); *A45D 7/00* (2013.01)

(58) Field of Classification Search
CPC ..... A45D 2/00; A45D 2/12; A45D 2/122; A45D 2/125; A45D 2/127; A45D 2/18;
(Continued)

(56) References Cited

U.S. PATENT DOCUMENTS 3,255,765 A 6/1966 Sturdivant
3,835,871 A 9/1974 Roccanova
6,394,101 B1 * 5/2002 Secreto ..... A45D 2/18 132/222
(Continued)

FOREIGN PATENT DOCUMENTS

CN 103099419 A 5/2013
EP 1925228 A1 * 5/2008
(Continued)

OTHER PUBLICATIONS

International Search Report, issued in PCT/JP2019/003541, dated May 7, 2019.
(Continued)

*Primary Examiner* — Rachel R Steitz
(74) *Attorney, Agent, or Firm* — Birch, Stewart, Kolasch & Birch, LLP

(57) ABSTRACT

A hair holder (1) of the present invention includes a tubular body (2) and a fixing member (5). The tubular body (2) has a first surface sheet (23A) and a second surface sheet (23B). The second surface sheet (23B) has a plurality of slits (25) that extends in a width direction and that is intermittently arranged along a longitudinal direction. The fixing member (5) has a first member (5*a*) and second members (5*b*) that can be detachably joined together. The first member (5*a*) is arranged on the first surface sheet (23A) on the side of a first opening (21) located at a first end in the longitudinal direction. The second surface sheet (23B) has a central region (M) in the width direction, where the plurality of slits is provided, and a pair of side regions (S) each of which is located on opposite sides of the central region (M). The second members (5*b*) are arranged in the pair of side regions (S), respectively, so as to extend in the longitudinal direction.

17 Claims, 8 Drawing Sheets

(51) Int. Cl.
*A45D 6/04* (2006.01)
*A45D 7/00* (2006.01)

(58) Field of Classification Search
CPC ..... A45D 2/20; A45D 2/22; A45D 2002/007; A45D 2002/008; A45D 2002/025; A45D 6/04; A45D 7/00; A45D 7/04
See application file for complete search history.

(56) References Cited

U.S. PATENT DOCUMENTS

| | | | |
|---|---|---|---|
| 2006/0032513 | A1 | 2/2006 | Tojo et al. |
| 2006/0157078 | A1 | 7/2006 | Tojo et al. |
| 2017/0332763 | A1 | 11/2017 | DiRienzo |

FOREIGN PATENT DOCUMENTS

| | | | |
|---|---|---|---|
| EP | 3 689 177 | A | 8/2020 |
| EP | 3 689 178 | A1 | 8/2020 |
| EP | 3 689 179 | A1 | 8/2020 |
| JP | 2004-57256 | A | 2/2004 |
| JP | 2004-209237 | A | 7/2004 |
| JP | 2004-222766 | A | 8/2004 |
| JP | 2005-246040 | A | 9/2005 |
| JP | 2006-68368 | A | 3/2006 |
| JP | 2006-129972 | A | 5/2006 |
| JP | 2010-29348 | A | 2/2010 |
| WO | WO 2020/157603 | A1 | 8/2020 |
| WO | WO 2020/157604 | A1 | 8/2020 |
| WO | WO 2020/157605 | A1 | 8/2020 |

OTHER PUBLICATIONS

Written Opinion of the International Searching Authority, issued in PCT/JP2019/003541, dated May 7, 2019.

European Patent Office Communication and extended search report issued in the corresponding European Patent Application No. 19912966.9 dated Aug. 12, 2022.

* cited by examiner

HAIR HOLDER, METHOD FOR PRODUCING SAID HAIR HOLDER, AND METHOD FOR USING SAID HAIR HOLDER

TECHNICAL FIELD

The present invention relates to a hair holder, a method for producing the hair holder, and use of the hair holder.

BACKGROUND ART

As a method for imparting a curled shape to a lock of hair, a method is known in which a lock of hair is inserted into a tubular body of a hair holder and the tubular body is then rolled up. An example of the hair holder used in such a method is disclosed in Patent Literature 1.

Usually, after a hair holder such as that described above is rolled up together with a lock of hair, a curling treatment for imparting a curled shape to the lock of hair is performed. In this case, it is necessary to maintain the tubular body in the rolled-up state while the curling treatment is being performed. From the viewpoint of maintaining the rolled-up state of the tubular body, the applicant of the present invention has proposed, in Patent Literature 2, a hair holder in which a sheet that forms a first surface of a tubular body is constituted by an engagement sheet that is engageable with a male mechanical fastener, and a male mechanical fastener that is engageable with the engagement sheet is provided on a second surface of the tubular body in the vicinity of an opening through which a lock of hair can be inserted.

The applicant of the present invention has also proposed, in Patent Literature 3, a hair holder in which a first mechanical fastener is provided on a first surface of a tubular body in the vicinity of an end portion thereof, and a plurality of second mechanical engagement portions that are engageable with the first mechanical fastener are provided on a second surface of the tubular body such that the second mechanical engagement portions are arranged at predetermined intervals in a longitudinal direction. In addition, the applicant of the present invention has also proposed that a plurality of slits is provided on the first surface of the tubular body.

CITATION LIST

Patent Literature

Patent Literature 1: U.S. Pat. No. 3,255,765
Patent Literature 2: JP 2004-222766A
Patent Literature 3: JP 2004-209237A

SUMMARY OF INVENTION

The present invention relates to a hair holder including a tubular body and a fixing member, the tubular body having: a first opening located at a first end; and a second opening located at a second end, and being configured to allow a lock of hair to be inserted from the first opening toward the second opening and to be capable of being rolled up, and the fixing member maintaining a state in which the tubular body is rolled up. The tubular body has a longitudinal direction and a width direction that is orthogonal to the longitudinal direction. The tubular body has a first surface sheet and a second surface sheet. When the tubular body is rolled up, the first surface sheet is located on the inside of the tubular body and the second surface sheet is located on the outside of the tubular body. The second surface sheet has a plurality of slits that extends in the width direction and that is intermittently arranged along the longitudinal direction. The fixing member has a first member and second members that can be detachably joined together. The first member is arranged on the first surface sheet on the side of the first opening in the longitudinal direction. The second surface sheet has a central region in the width direction where the plurality of slits is provided. The second surface sheet has a pair of side regions each of which is located on opposite sides of the central region. The second members are arranged in the pair of side regions, respectively, so as to extend in the longitudinal direction.

Also, the present invention relates to a method for producing the hair holder. In the method for producing the hair holder of the present invention, the second members and the second surface sheet are integrated by fusion bonding.

Also, the present invention relates to a method for producing the hair holder. In the method for producing the hair holder of the present invention, the second members and the second surface sheet are integrated by adhesion.

Also, the present invention relates to a method for producing the hair holder. In the method for producing the hair holder of the present invention, the second members and the second surface sheet are integrated by sewing.

Also, the present invention relates to use of the hair holder. The use of the hair holder of the present invention includes inserting a lock of hair into the tubular body, rolling up the tubular body, and performing a curling treatment on the lock of hair.

DESCRIPTION OF EMBODIMENTS

A tubular body is known in which slits are formed to make it easy to wind the tubular body and efficiently apply a hair treatment agent such as a perming agent to a lock of hair in the tubular body in the wound state. However, when releasing the tubular body from the wound state, stress may be concentrated in end portions of the slits. If the stress is high, the tubular body may become damaged in the vicinity of an end portion of the slit.

Patent Literature 1 does not disclose a means for maintaining the tubular body in the wound state, and the slits.

The hair holders disclosed in Patent Literatures 2 and 3 leave room for improvement in terms of preventing stress from being concentrated in the vicinity of the end portions of the slits when the wound state is released.

Therefore, the present invention provides a hair holder that can eliminate the drawbacks of related art described above, and a method for producing the hair holder.

Hereinafter, a hair holder of the present invention will be described based on preferred embodiments thereof, with reference to the drawings. The hair holder of the present invention is used to perform a curling treatment for curling a lock of hair. "Curling" refers to imparting a particular shape, such as a curled shape or a spiral shape, to a lock of hair.

The hair holder of the present invention is mainly used for head hair.

Figure 1A:
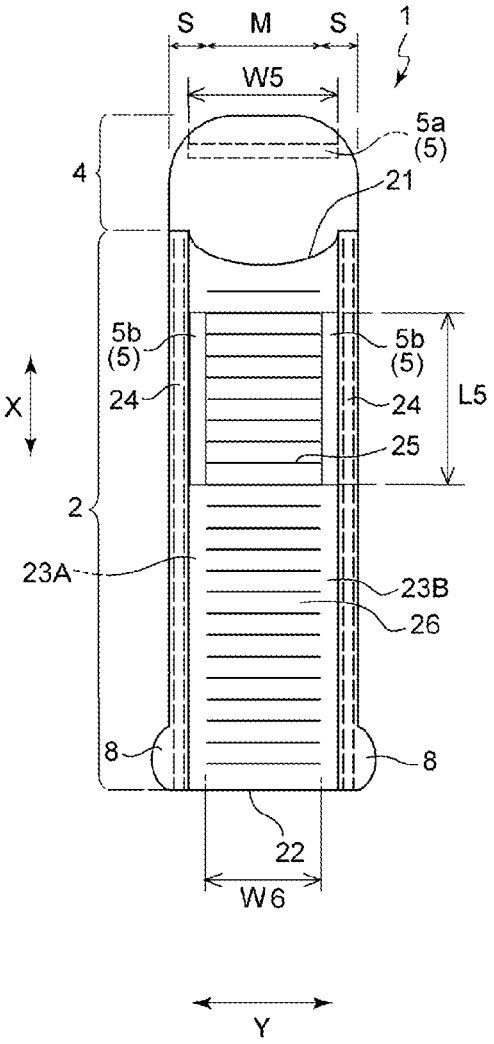
FIGS. 1(*a*) and 1(*b*) are a front view and a rear view, respectively, showing an embodiment of a hair holder of the present invention.
Figure 1B:
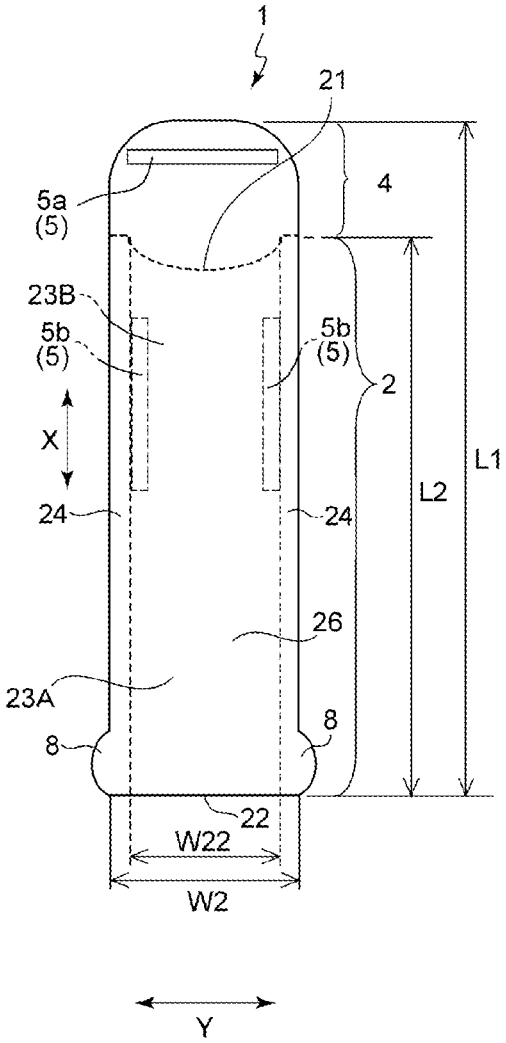

FIGS. 1(*a*) and 1(*b*) show an embodiment of the hair holder of the present invention. A hair holder 1 shown in FIGS. 1(*a*) and 1(*b*) includes a tubular body 2 into which a lock of hair H can be inserted from a first opening 21 located at a first end toward a second opening 22 located at a second end. Specifically, the tubular body 2 includes two sheets 23A and 23B that are elongated in one direction, the two sheets serving as a first surface sheet 23A and a second surface sheet 23B, which will be described later, and has a flat shape in which the two sheets 23A and 23B are laid one on top of the other. Also, the tubular body 2 has a pair of side joint portions 24 where the first surface sheet 23A and the second surface sheet 23B are joined to each other, and a tubular portion 26 that is located between the pair of side joint portions 24. Each of the two side joint portions 24 is formed by joining side edge portions of the two sheets 23A and 23B to each other, the side edge portions extending along the extending direction of the two sheets. The tubular portion 26 has, between the first opening 21 and the second opening 22 in a longitudinal direction X, a space into which the lock of hair H can be inserted. In the present embodiment, the side joint portions 24 are formed by sewing the two sheets together using a sewing thread. Note that, the sewing threads of the side joint portions 24 are not shown in FIGS. 4 to 6, which will be described later.

The tubular body 2 of the present embodiment has the longitudinal direction X and a width direction Y that is orthogonal to the longitudinal direction X. The longitudinal direction X of the tubular body 2 is the same as the extending direction of the tubular portion 26 and corresponds to the direction in which the lock of hair H is inserted.

Opposite side edge portions of the tubular body 2 that extend along the longitudinal direction X are parallel to each other as shown in the present embodiment; however, the opposite side edge portions do not need to be parallel to each other. In that case, it is preferable that the opposite side edge portions extend gradually outward in the width direction Y from the first opening 21 toward the second opening 22. In other words, it is preferable that, in a plan view, the tubular body 2 has a shape that widens toward the second opening 22.

Figure 2:
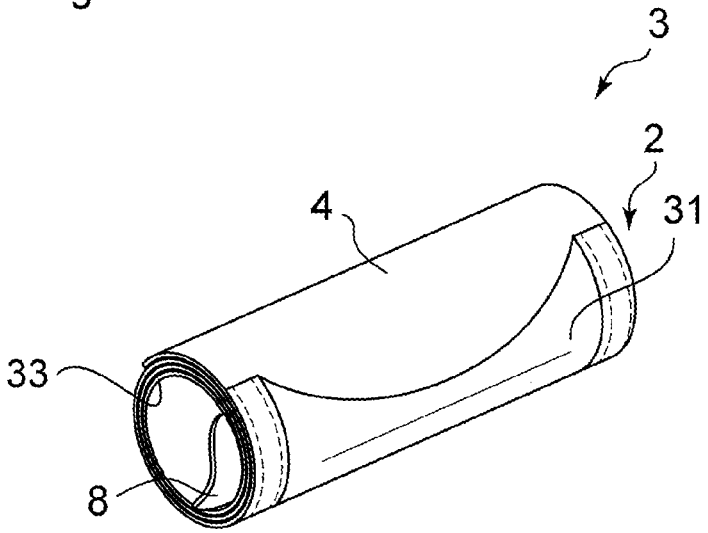
FIG. 2 is a perspective view showing a lock-of-hair holding body of the hair holder shown in FIG. 1.

The tubular body 2 is configured to be capable of being rolled up. Being configured to be capable of being rolled up means that the tubular body 2 can be wound into a roll shape as shown in FIG. 2. Such a configuration is preferably a configuration in which the tubular body 2 automatically rolls up, but may also be a configuration in which the tubular body 2 is manually rolled up. An example of the automatic rolling-up configuration is a configuration in which the tubular body 2 is wound in a roll shape in its natural state, and after stretching out the tubular body 2 and inserting a lock of hair H therein, the tubular body 2 rolls up together with the lock of hair H upon being released from the stretched state. Such a configuration can be realized by either or both of the first surface sheet 23A and the second surface sheet 23B being made of a shape memory sheet that has preliminarily retained the state in which the hair holder 1 is rolled up. The shape memory sheet can be formed by bonding together films having different heat shrinkage rates or films having different tensions, for example. Moreover, the tubular body 2 may also return to its retained original roll shape when the sheets 23A and 23B constituting the tubular body 2 are heated. The term "natural state" as used herein means a state in which a hair holder is placed on a horizontal plane in an environment at a temperature of 20° C. and a humidity of 40%, without an external force applied to the hair holder.

A sheet that is located on the inside of the tubular body 2 when the tubular body 2 is rolled up is also referred to as the first surface sheet 23A, and a sheet that is located on the outside of the tubular body 2 when the tubular body 2 is rolled up is also referred to as the second surface sheet 23B.

After the lock of hair is inserted into the hair holder from the first opening toward the second opening, the tubular body is rolled up together with the lock of hair, and thus, the hair holder is deformed into a roll shape. In the following description, the tubular body that has been rolled up into a roll shape will also be referred to as a lock-of-hair holding body. In the lock-of-hair holding body, the second opening is located nearer to the center of the roll that has been rolled up. The center is on the central axis of the lock-of-hair holding body that is roll-shaped. In the following description, the center of the lock-of-hair holding body will also be referred to simply as the "center". The lock-of-hair holding body has a spiral shape in a cross section taken in a radial direction that is orthogonal to the direction of the central axis.

The hair holder has a fixing member 5 that maintains a state in which the tubular body is rolled up. That is to say, the fixing member 5 can keep the tubular body in a roll shape. The fixing member 5 has a first member 5*a* and second members 5*b* that can be detachably joined together. A joint member constituted by a plurality of members that can be detachably joined to each other, or a male and female member assembly, may be used as such a fixing member 5. Examples of the joint member include an adherend-selective pressure-sensitive adhesive tape, a magnet, and the like. Examples of the male and female member assembly include a hook and eye, a mechanical hook-and-loop fastener, and the like.

The adherend-selective pressure-sensitive adhesive tape is a type of pressure-sensitive adhesive tape that adheres only to a particular substance and substantially does not adhere to any other substances. The wording "substantially does not adhere" includes not only a case where the adherend-selective pressure-sensitive adhesive tape does not create an adhesion state with any substance other than the particular substance but also a case where, even though the adherend-selective pressure-sensitive adhesive tape creates an adhesion state with a substance other than the particular substance, the adhesion state quickly disappears if a slight relative movement occurs between that substance and the adherend-selective pressure-sensitive adhesive tape. Such adherend-selective pressure-sensitive adhesive tape includes a tape base material and a self-adhesive agent applied to the tape base material, and the self-adhesive agent adheres only to a substance of the same kind and substantially does not adhere to other substances. That is to say, the self-adhesive agent has adhesiveness only to the self-adhesive agent itself.

As an example of the adherend-selective pressure-sensitive adhesive tape having the above-described configuration, a type of pressure-sensitive adhesive tape that includes a self-adhesive agent and a tape base material and is disclosed in JP 2007-167192A can be used.

The second surface sheet has a plurality of slits that extends in the width direction Y and that is intermittently arranged along the longitudinal direction X. With this configuration, the tubular body 2 can be smoothly rolled up. In the present embodiment, the slits penetrate the second surface sheet in its thickness direction.

Figure 9:
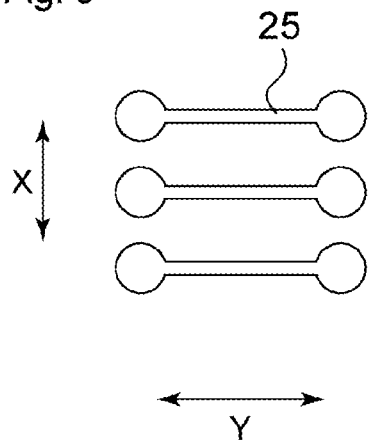
FIG. 9 is an enlarged plan view showing another embodiment of slits shown in FIG. 1(*a*).

The hair holder 1 of the present embodiment has a plurality of said slits 25 in the second surface sheet 23B, and the plurality of slits is arranged in series. In the present embodiment, all of the slits 25 have the same length in the width direction Y, but the slits may have different lengths in the width direction Y. Moreover, as shown in FIG. 9, each of the slits may have a circular portion at both end portions thereof. In each slit shown in FIG. 9, the two end portions have a longer length in the longitudinal direction X than a straight-line portion located in the middle of the slit in the width direction Y. The two end portions of each such slit may be formed in a circular shape through punching, for example.

The hair holder 1 of the present embodiment has an extended portion 4 on the first opening 21 side of the tubular body 2, the extended portion 4 being constituted by the first surface sheet 23A extending outward in the longitudinal direction X from the tubular body 2. The extended portion 4 is integrally formed with the first surface sheet 23A. Although the hair holder does not need to have the extended portion, it is preferable that the hair holder has the extended portion, from the viewpoint of making it easy to insert the lock of hair into the tubular body.

The first member is provided on the first surface sheet on the side of the first opening in the longitudinal direction X. As long as the first member is provided on the side of the first opening in the longitudinal direction X, the first member may be provided on a portion of the first surface sheet that forms the tubular body 2 or a portion of the first surface sheet that does not form the tubular body 2. An example of the portion that does not form the tubular body 2 is the above-described extended portion.

In the case of the first surface sheet 23A of the present embodiment, the first member 5*a* is provided on the extended portion 4 that is located on the side of the first opening 21 in the longitudinal direction X. As shown in FIG. 1(*b*), the first member 5*a* is located on an outer surface side of the extended portion 4 and has a shape that is elongated in the width direction Y. The term "outer surface" means a surface of the hair holder 1 that is opposite to a surface that defines the space into which the lock of hair can be inserted.

The second surface sheet has a central region M in the width direction Y where the plurality of slits 25 is provided. And the second surface sheet has a pair of side regions S, each of which is located on opposite sides of the central region M. The central region M is a region where the plurality of slits 25 is arranged, and is located in the middle of the tubular body 2 in the width direction Y. The pair of side regions S is formed on the outside of the central region M in the width direction Y so as to sandwich the central region M from both sides.

The second members are provided on the second surface sheet in the pair of side regions S, respectively, so as to extend in the longitudinal direction X. As shown in FIG. 1(*a*), the second members 5*b* of the present embodiment are located on an outer surface side of the second surface sheet 23B and are formed so as to continuously extend in the longitudinal direction X.

The hair holder 1 of the present embodiment keeps the tubular body 2 in the rolled-up state as shown in FIG. 2 and is thereby used to perform a curling treatment on the lock of hair H. In the hair holder 1, when the tubular body 2 is rolled up into the lock-of-hair holding body 3, the outer surface of the first surface sheet 23A and the outer surface of the second surface sheet 23B partially face each other. More specifically, in the lock-of-hair holding body 3, or in other words, in the tubular body 2 in the rolled-up state, the outer surface of a portion of the first surface sheet 23A is located on the side of the first opening 21 in the longitudinal direction X and constitutes an outer circumferential portion 31. The outer surface of a portion of the second surface sheet 23B constitutes a wound portion that is adjacent to the outer circumferential portion 31. And the outer surface of a portion of the first surface sheet 23A faces the outer surface of a portion of the second surface sheet 23B The outer circumferential portion 31 is a wound portion that is the farthest from the central axis in the tubular body 2 in a wound state, and is a portion that has the largest roll diameter in the tubular body 2 when rolled up into a roll shape. Then, the first member 5*a* and the second members 5*b* that are located on these portions of the two sheets 23A and 23B that face each other can be joined together. Thus, the tubular body 2 is kept in the rolled-up state, or in other words, a roll shape. Moreover, the lock of hair H held in the tubular body 2 is also kept in a roll shape. As a result, the hair holder 1 can impart a curled shape to the lock of hair H.

Note that, in the present embodiment, the outer circumferential portion 31 is a wound portion of the tubular body 2 and does not contain the extended portion 4.

With the hair holder 1 of the present embodiment, in a state in which the tubular body 2 is rolled up, a hair treatment agent such as a perming agent can be injected into the tubular body 2 from the slits 25. In the hair holder 1 of the present embodiment, since the second members 5*b* are respectively located in the two side regions S on the second surface sheet 23B, when the hair treatment agent is injected, the hair treatment agent is unlikely to be absorbed by the second members 5*b* and can thus be efficiently applied to the lock of hair H in the rolled-up tubular body 2.

Also, in the hair holder 1 of the present embodiment, when releasing the tubular body 2 from a wound state, the first member 5*a* and the second members 5*b* are detached from each other in the pair of side regions S, and therefore, stress that is produced during the detachment is unlikely to be concentrated in, or in the vicinity of, end portions of the slits 25. Thus, the tubular body can be prevented from being damaged in the vicinity of the end portions of the slits due to stress that is produced when releasing the tubular body 2 from the wound state.

In contrast, if a fixing member is disposed in a middle portion of the tubular body in the width direction Y, the fixing member may absorb the hair treatment agent, thereby making it difficult to efficiently apply the hair treatment agent to the lock of hair. Moreover, since components of the fixing member are joined to each other in the middle portion, the middle portion is pulled when releasing the tubular body from the wound state, and stress that is produced during the detachment is concentrated in, or in the vicinity of, the end portions of the slits. Thus, a portion between the slits of the second surface sheet may become torn, and thereby the tubular body may become damaged.

Figure 3:
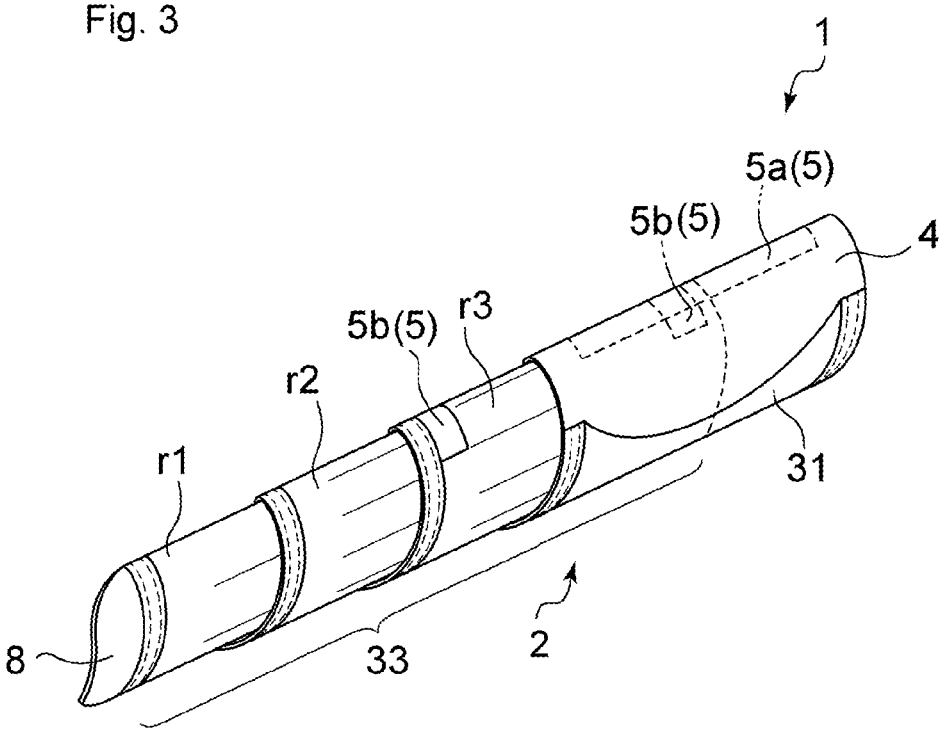
FIG. 3 is a perspective view showing a state in which the tubular body shown in FIG. 1 is kept in a spiral shape.

Furthermore, with the hair holder 1 of the present embodiment, the tubular body 2 can be rolled up and kept in a roll shape as shown in FIG. 2, and the tubular body 2 can also be deformed from the roll shape into a spiral shape and kept in the spiral shape as shown in FIG. 3.

The tubular body 2 can be deformed into a spiral shape in the following manner.

The tubular body 2 is rolled up into a roll shape to form the lock-of-hair holding body 3. The lock-of-hair holding body 3 has the outer circumferential portion 31 and a portion 33 that is located nearer to the center than the outer circumferential portion 31. Hereinafter, the portion 33 that is located nearer to the center will also be referred to as the "center-side portion 33". In the lock-of-hair holding body 3, the center-side portion 33 is located relatively near to the central axis compared with the outer circumferential portion 31, and has a smaller roll diameter than the outer circumferential portion 31. The number of turns of the center-side portion 33 may be less than one, or equal to one, or may be two or more. The center-side portion 33 of the lock-of-hair holding body 3 shown in FIG. 2 is formed with three turns.

The center-side portion 33 of the lock-of-hair holding body 3 is pulled out toward a lateral side of the lock-of-hair holding body 3 to thereby deform the tubular body 2 into a spiral form as shown in FIG. 3. The "lateral side of the lock-of-hair holding body 3" refers to an outward side of the lock-of-hair holding body 3 in the width direction Y of the tubular body 2, and the lateral side extends along the direction of the central axis of the lock-of-hair holding body 3. The center-side portion is shifted from the outer circumferential portion of the lock-of-hair holding body 3 toward the aforementioned lateral side by pulling out the center-side portion toward the lateral side of the lock-of-hair holding body 3 as described above, and thus, the tubular body 2 is deformed into a spiral form. In the tubular body 2 shown in FIG. 3, wound portions of the thus pulled-out center-side portion 33 are individually referred to as a first wound portion r1, a second wound portion r2, and a third wound portion r3 in descending order of distance from the outer circumferential portion 31. The tubular body 2 that has been deformed into the spiral form has a shape that tapers down as the distance from the outer circumferential portion 31 increases. That is to say, the length thereof in the radial direction decreases from the third wound portion r3 toward the first wound portion r1.

When the tubular body 2 has been deformed into the spiral shape, the second members 5*b* extending in the longitudinal direction X can thus be joined to the first member 5*a* that is located on the first surface sheet 23A on the side of the first opening 21. Because, the second members 5*b* are located on the outer circumferential portion 31 that has the largest roll diameter, or located on another wound portion that is adjacent to the outer circumferential portion 31. In the present embodiment, as shown in FIG. 3, the first member 5*a* and one of the second members 5*b* are joined together in a portion where the third wound portion r3 and the outer circumferential portion 31 overlap each other. As a result of the first and second members being joined together, the hair holder 1 can keep the tubular body 2 in the spiral shape and can also keep the lock of hair H in the tubular body 2 in a spiral shape. In this manner, the hair holder 1 of the present embodiment can impart a spiral shape to the lock of hair H that is held in the tubular body 2, and therefore has a high degree of freedom in terms of shape that can be imparted to the lock of hair.

In the case where the fixing member is a male and female member assembly, a configuration may be employed in which the first member is a male member and the second members are female members, or the first member is a female member and the second members are male members. On the other hand, there may be a case where, after the tubular body has been rolled up together with the lock of hair, an excess portion of the lock of hair that protrudes from the tubular body is wrapped around the outer circumferential portion of the tubular body. From the viewpoint of restraining entanglement of the excess portion wrapped around the outer circumferential portion of the tubular body with the fixing member, it is preferable that the first member is a male member of a mechanical hook-and-loop fastener and the second members are female members of the mechanical hook-and-loop fastener.

Figure 4:
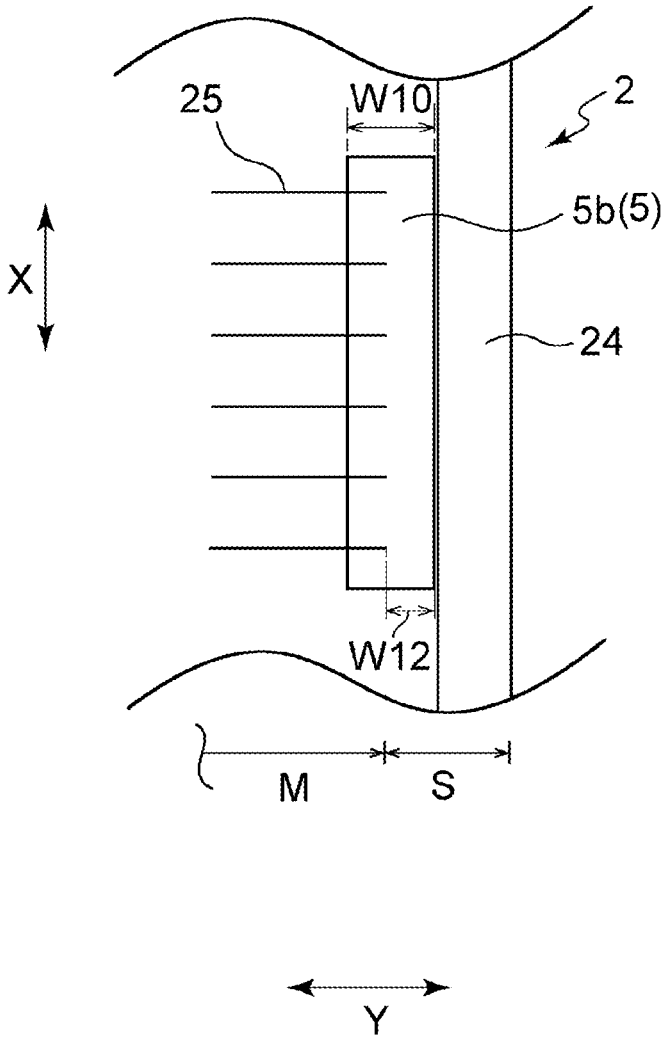
FIG. 4 is an enlarged plan view for describing an arrangement of second members according to the present invention.

From the viewpoint of restraining damage to the slits due to stress when the stress is produced for a reason other than detachment of the first member and the second members from each other, or more specifically, for example, when stress that is produced as a result of a hair insertion tool or a finger getting caught in a slit is concentrated in an end portion of the slit, it is preferable that the second members are arranged so as to overlap end portions of certain slits. In this case, as shown in FIG. 4, each second member 5*b* partially extends out from the side region S into the central region M.

From the viewpoint of more reliably preventing damage to the tubular body 2 caused by such stress, the length W12 (see FIG. 4) of a portion of each second member 5*b* that is present in a corresponding one of the side regions S is preferably 50% or greater and more preferably 70% or greater, is preferably 100% or less and more preferably 90% or less, and is preferably from 50% to 100% and more preferably from 70% to 90% of the length W10 (see FIG. 4) of that second member 5*b* in the width direction Y.

In addition, from the viewpoint of reducing the difference in roll diameter between the wound portions, it is preferable that the second members are arranged at positions that do not overlap the side joint portions.

The second members may continuously extend in the longitudinal direction X as shown in the present embodiment, or may intermittently extend in the longitudinal direction X. When the second members "intermittently extend", this means that the second members are each constituted by a plurality of small second members 5*d* that are lined up in the longitudinal direction X so as to be spaced apart from each other, as shown in FIG. 5(*a*).

From the viewpoint of widely adjusting the roll diameter of the spiral formed by the tubular body, the length L5 (see FIG. 1(*a*)) of each second member in the longitudinal direction X is preferably 10% or greater and more preferably 20% or greater, is preferably 100% or less and more preferably 90% or less, and is preferably from 10% to 100% and more preferably from 20% to 90% of the length L2 (see FIG. 1(*b*)) of the tubular body 2 in the longitudinal direction X.

Figure 5A:
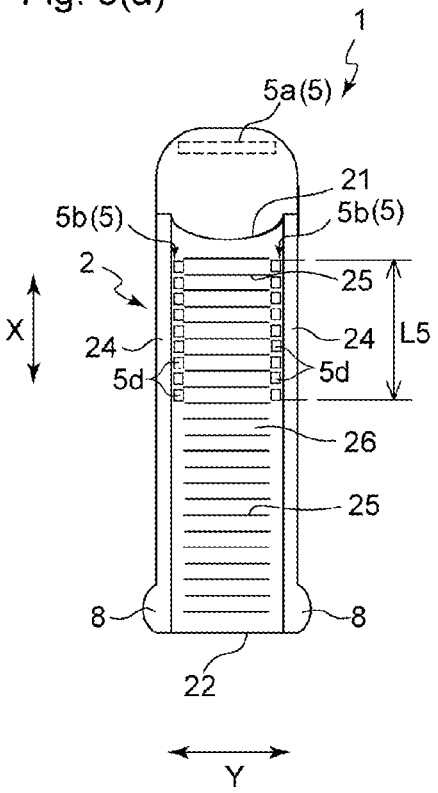
FIGS. 5(*a*) and 5(*b*) are front views showing forms of a first member and second members according to the present invention.
Figure 5B:
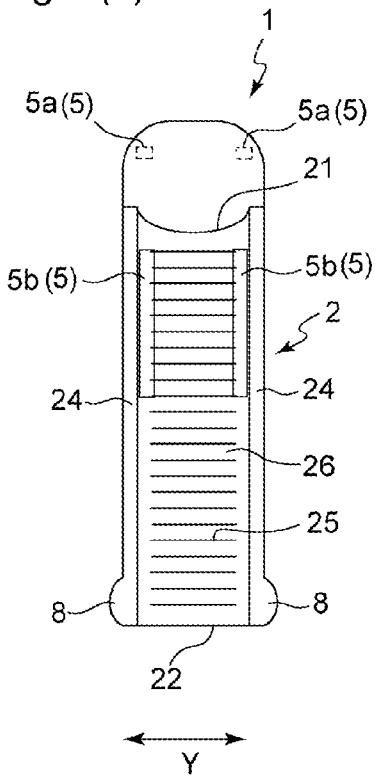

In the case where the second members intermittently extend in the longitudinal direction X, the length L5 of each second member in the longitudinal direction X refers to a length that contains the lengths between the small second members 5*d* (see FIG. 5(*a*)).

In the case where the second members intermittently extend, the small second members 5*d* may be located between slits in the longitudinal direction X as shown in FIG. 5(*a*), or may be located overlapping the slits in the longitudinal direction X.

From the viewpoint of easily deforming the tubular body into a spiral shape that has a small diameter, it is preferable that the second members are arranged on the side of the first opening 21 in the longitudinal direction X. From the same viewpoint, the second members are arranged within a range of preferably 0% to 90%, more preferably 5% to 85%, and even more preferably 10% to 80% of the length L2 (see FIG. 1(*b*)) of the tubular body in the longitudinal direction X from the first opening 21 in the longitudinal direction X. Here, the wording "0% of the length L2 of the tubular body in the longitudinal direction X from the first opening 21" in the longitudinal direction X refers to a position that coincides with the first opening 21 in the longitudinal direction X, and means that the second members are arranged such that end portions of the second members on the first opening 21 side coincide with the first opening 21.

The first member may continuously extend in the width direction Y as shown in the present embodiment, or may intermittently extend in the width direction Y. When the first member "intermittently extends", this means that the first member is constituted by a plurality of small first members that are lined up in the width direction Y so as to be spaced apart from each other. In addition, as shown in FIG. 5(*b*), a plurality of first members may also be arranged at positions that are spaced apart from each other in the width direction Y.

Irrespective of the form of the first member, the hair holder that has the second members extending in the longitudinal direction X can keep the tubular body in a spiral shape in the above-described manner. From the viewpoint of easily performing fine adjustment of the roll diameter of the spiral, it is preferable that the first member has a shape that is elongated in the width direction Y. Also, from the same viewpoint, the length W5 (see FIG. 1(*a*)) of the first member in the width direction Y is preferably 70% or greater and more preferably 80% or greater, is preferably 100% or less and more preferably 95% or less, and is preferably from 70% to 100% and more preferably from 80% to 95% of the length W2 (see FIG. 1(*b*)) of the tubular body 2 in the width direction Y. In the case where the first member intermittently extends in the width direction Y, the length W5 of the first member in the width direction Y is a length that contains the lengths between the small first members. In the case where a plurality of first members are arranged at positions that are spaced apart from each other in the width direction Y, it is preferable that the sum of the lengths of the plurality of first members in the width direction Y is within the above-described range.

From the viewpoint of enhancing the rolling-up force of the hair holder, it is preferable that the hair holder has a reinforcement material in the pair of side joint portions 24. A reinforcement material 7 is a sheet that is disposed for the purpose of enhancing the rolling-up force of the tubular body 2. The length of the reinforcement material 7 in the width direction Y may be such a length that the reinforcement material 7 does not span between the pair of side joint portions 24. It is preferable that reinforcement materials 7 are arranged in both of the two side joint portions 24 of the tubular body 2 so as to extend in the longitudinal direction X, and it is more preferable that the reinforcement materials 7 are arranged overlapping the respective side joint portions 24.

Figure 6A:
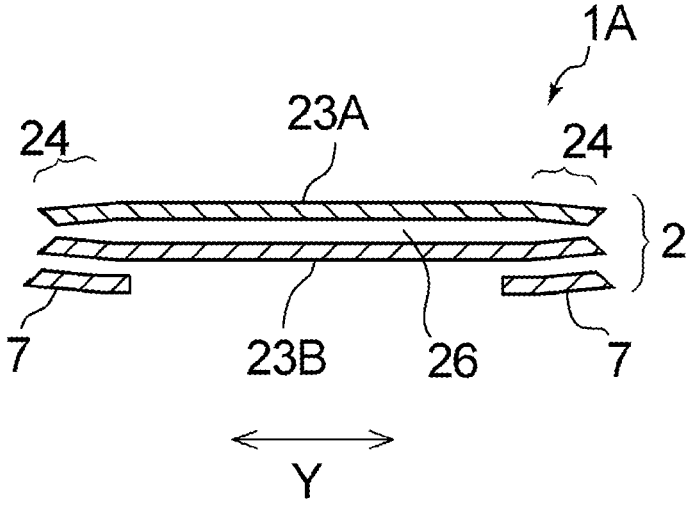
FIGS. 6(*a*) and 6(*b*) are schematic diagrams each showing a cross section in a thickness direction of a hair holder that has a reinforcement material, taken along a width direction thereof.
Figure 6B:
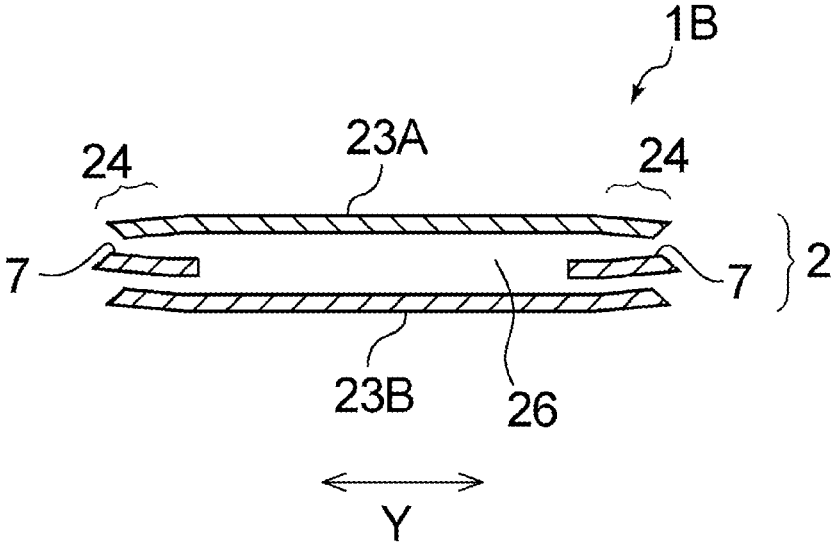
Figure 7A:
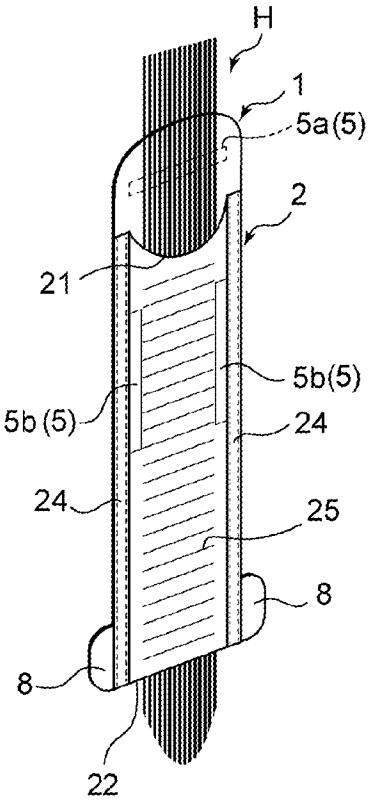
FIG. 7 shows explanatory diagram sequentially illustrating procedures for performing a curling treatment using the hair holder shown in FIG. 1.
Figure 7B:
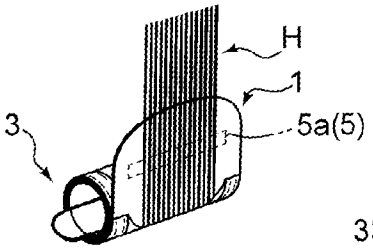
Figure 7C:
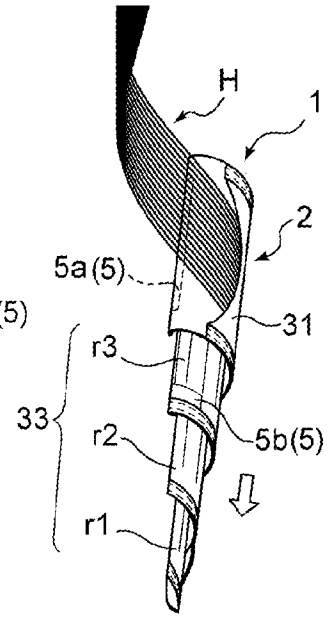
Figure 7D:
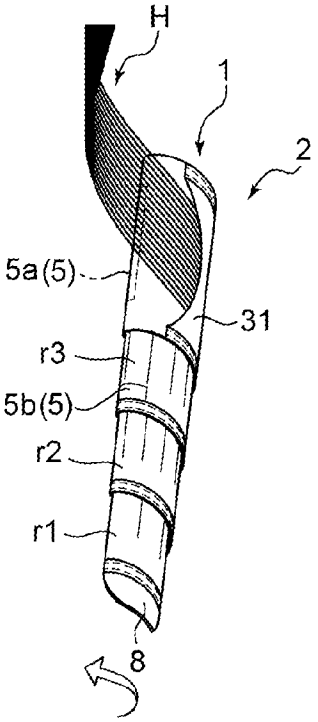

FIGS. 6(*a*) and 6(*b*) show hair holders that have reinforcement materials described above. A hair holder 1A shown in FIG. 6(*a*) has reinforcement materials 7 that are arranged on the outer surface of one of the two sheet materials 23A and 23B that constitute the tubular portion 26. From the viewpoint of enhancing the rolling-up force even more, it is preferable that the reinforcement materials 7 are arranged on the outer surface of the second surface sheet 23B. A hair holder 1B shown in FIG. 6(*b*) has reinforcement materials 7 that are arranged between the two sheet materials 23A and 23B that constitute the tubular portion 26. Note that, although the sheets that constitute the tubular body 2 are joined to each other in the side joint portions 24, a gap is shown between the sheets that constitute the tubular body 2 in FIGS. 6(*a*) and 6(*b*) for the sake of convenience of description.

A material that can enhance the rolling-up force of the hair holder 1 can be used for the reinforcement materials. For example, a sheet-like material may be used, such as a nonwoven fabric (a polyethylene nonwoven fabric, a polyethylene terephthalate nonwoven fabric, or the like), a woven fabric, a net-like sheet, a porous or non-porous resin film (a polyethylene film, a polyethylene terephthalate film, or the like), paper, a polymer material sheet, a rubber sheet, or a composite of these materials.

As shown in FIGS. 1(*a*) and 1(*b*), the hair holder 1 of the present embodiment has winding and tightening tabs 8 on the opposite side edge portions, respectively, that extend in the longitudinal direction X of the tubular body 2, the winding and tightening tabs 8 being located in the vicinity of the second opening 22. As shown in FIG. 1(*b*), the winding and tightening tabs 8 are integrally formed with the first surface sheet 23A so as to extend outward in the width direction Y from the tubular body 2, and each have a semicircular shape in a plan view. Due to the hair holder having the winding and tightening tabs, the tubular body can be rolled up easily, and tightly, if necessary, by holding the winding and tightening tabs with hands and rolling up the tubular body. Moreover, preferably, the tubular body can be easily deformed into a spiral shape by holding a winding and tightening tab 8 and pulling out the center-side portion toward a lateral side. The formation method, shape, size, thickness, arrangement, and the like of the winding and tightening tabs 8 can be set appropriately.

The dimensions and the like of the tubular body 2 can be appropriately determined in accordance with the length of hair, the section of hair that is desired to be curled, and the volume of a lock of hair to be inserted, but are preferably within the following ranges.

The length W2 (see FIG. 1(*b*)) of the tubular body 2 in the width direction Y is preferably 25 mm or greater and more preferably 30 mm or greater, is preferably 200 mm or less and more preferably 150 mm or less, and is preferably from 25 to 200 mm and more preferably from 30 to 150 mm.

The length L1 (see FIG. 1(*b*)) of the hair holder 1 in the longitudinal direction X is preferably 50 mm or greater and more preferably 100 mm or greater, is preferably 400 mm or less and more preferably 350 mm or less, and is preferably from 50 to 400 mm and more preferably from 100 to 350 mm. The length L1 of the hair holder 1 in the longitudinal direction X is the sum of the lengths of the extended portion 4 and the tubular body 2 in the longitudinal direction X.

The length L2 (see FIG. 1(*b*)) of the tubular body 2 in the longitudinal direction X is preferably 45 mm or greater and more preferably 90 mm or greater, is preferably 300 mm or less and more preferably 275 mm or less, and is preferably from 45 to 300 mm and more preferably from 90 to 275 mm. An end portion of the tubular body 2 of the present embodiment on the side of the first opening 21 is curved into a concave shape curving inward in the longitudinal direction X. In the case where the length of the tubular body 2 in the longitudinal direction X varies depending on the position in the width direction Y in this manner, it is preferable that the maximum length of the tubular body 2 in the longitudinal direction X is within the aforementioned range.

The length W22 (see FIG. 1(*b*)) of the second opening 22 in the width direction Y relative to the length W2 (see FIG. 1(*b*)) of the tubular body 2 in the width direction Y is preferably 40.0% or greater and more preferably 66.7% or greater, is preferably 97.5% or less and more preferably 96.7% or less, and is preferably from 40.0% to 97.5% and more preferably from 66.7% to 96.7%.

The length W22 (see FIG. 1(*b*)) of the second opening 22 in the width direction Y is preferably 10 mm or greater and more preferably 20 mm or greater, is preferably 195 mm or less and more preferably 145 mm or less, and is preferably from 10 to 195 mm and more preferably from 20 to 145 mm.

In the present embodiment, the length W22 of the second opening 22 in the width direction Y is equal to the length of the first opening 21 in the width direction Y. In the width direction Y, the length of the second opening 22 and the length of the first opening 21 may be equal to each other or may be different from each other.

Here, the slits 25 extending in the width direction of the second surface sheet 23B means slits with a width of less than 3 mm. Also, the length W6 (see FIG. 1(*a*)) of the slits 25 in the width direction Y relative to the length W2 of the tubular body 2 in the width direction Y is preferably 40.0% or greater and more preferably 50.0% or greater, is preferably 90.0% or less and more preferably 80.0% or less, and is preferably from 40.0% to 90.0% and more preferably from 50.0% to 80.0%.

Moreover, the length W6 (see FIG. 1(*a*)) of the slits 25 in the width direction Y is preferably 10 mm or greater and more preferably 15 mm or greater, is preferably 180 mm or less and more preferably 120 mm or less, and is preferably from 10 to 180 mm and more preferably from 15 to 120 mm.

A method for performing a curling treatment using the hair holder of the present embodiment will be described. Hereinafter, the method for performing a curling treatment will also be referred to as a hair treatment method of the present embodiment. FIGS. 7(*a*) to 7(*d*) illustrate the hair treatment method of the present embodiment.

According to the hair treatment method of the present embodiment, a curling treatment is performed on a lock of hair H using the hair holder of the foregoing embodiment, by inserting the lock of hair H into the tubular body 2 and rolling up the tubular body 2. More specifically, the hair treatment method of the present embodiment includes: a step of inserting a lock of hair H into the tubular body 2; a step of forming the lock-of-hair holding body 3; a step of deforming the tubular body 2 into a spiral form; and a step of performing a curling treatment on the lock of hair H. In the following description, the step of inserting the lock of hair H into the tubular body 2 will also be referred to as an insertion step; the step of forming the lock-of-hair holding body 3 as a rolling-up step; the step of deforming the tubular body into a spiral shape as a deforming step; and the step of performing the curling treatment on the lock of hair as a curling treatment step.

In the present embodiment, the insertion step is performed at a stage prior to the rolling-up step. In this step, as illustrated in FIG. 7(*a*), a lock of hair H is inserted between the two sheets 23A and 23B that constitute the tubular body 2 from the first opening 21 toward the second opening 22 of the tubular body 2. Thus, in the tubular body 2, a root portion of the lock of hair H is located on the side of the first opening 21, and a hair tip portion of the lock of hair H is located on the side of the second opening 22. The operation of inserting the lock of hair H at the insertion step may be performed using an operator's hands, or may be performed using an elongated hair insertion tool for inserting a lock of hair H into the tubular body 2. An example of the hair insertion tool is a hair insertion tool having a locking portion that can lock the lock of hair H and an elongated, insertion tool main body that has a predetermined length. More specifically, in the hair insertion tool, the insertion tool main body is formed into an elongated plate-like shape, and an end portion thereof has a tapered shape so as to be easily inserted into the first opening. Preferably, the insertion tool main body is made of a hard synthetic resin sheet or the like. The locking portion is provided at one end of the insertion tool main body, formed into a ring shape that is longer than it is wide, and a lock of hair can be inserted through, and locked in, this ring.

In this step, it is sufficient that the lock of hair can be inserted into the tubular body, and the lock of hair does not need to penetrate the tubular portion 26. In other words, a leading end of the lock of hair does not need to protrude from the second opening of the tubular body.

In the rolling-up step, the tubular body 2 is rolled up together with the lock of hair inserted in the tubular body 2 to form the lock-of-hair holding body. In this rolling-up step, as illustrated in FIG. 7(*b*), the tubular body 2 is rolled up from the second opening 22 toward the first opening 21 along the longitudinal direction X. That is to say, the tubular body 2 is rolled up so that the second opening 22 is positioned on the center side of the lock-of-hair holding body 3 that is roll-shaped. Accordingly, a hair tip portion of the lock of hair H is located on the center side of the lock-of-hair holding body, and a root portion thereof is located on the outer circumferential portion side of the lock-of-hair holding body 3. In this step, the lock-of-hair holding body may be formed by the aforementioned configuration in which the tubular body 2 automatically rolls up, or may be formed by the aforementioned configuration in which the tubular body 2 is manually rolled up. It is also possible that the lock-of-hair holding body is formed by rolling up the tubular body 2 using the automatic rolling-up configuration and then further manually performing a winding and tightening operation or an unwinding operation. According to the hair treatment method of the present embodiment, in the case where a curled shape other than a spiral shape is to be imparted to a lock of hair, the procedures may be advanced to the curling treatment step without performing the next deforming step.

In the deforming step, as illustrated in FIG. 7(*c*), the center-side portion 33 of the lock-of-hair holding body 3 is pulled out toward a lateral side of the lock-of-hair holding body 3 to thereby deform the tubular body 2 into a spiral form. From the viewpoint of easily deforming the tubular body 2 into a spiral form, it is preferable that the center-side portion 33 is pulled out by holding the tubular portion 26, or either one of the side edge portions, in the vicinity of the second opening 22 in the longitudinal direction X, and it is more preferable that the center-side portion 33 is pulled out by holding either one of the side edge portions. Note that the hair holder 1 of the present embodiment has the winding and tightening tabs 8 on the side of the second opening 22 in the longitudinal direction X, and the center-side portion may also be pulled out by holding one of the winding and tightening tabs 8.

In the hair treatment method of the present embodiment, in the deforming step, an operation of winding and tightening, or unwinding, a portion that has been pulled out toward the lateral side of the lock-of-hair holding body is performed. In the following description, the winding and tightening operation or the unwinding operation will also be referred to as a winding adjustment operation. With this configuration, the roll diameter of the spiral shape of the lock of hair can be made substantially uniform. In the present embodiment, after the tubular body 2 has been deformed into a spiral form in the deforming step as illustrated in FIG. 7(*c*), the tubular body 2 is unwound as illustrated in FIG. 7(*d*) to reduce the differences in roll diameter between the various wound portions, namely, the first wound portion r1, the second wound portion r2, the third wound portion r3, and the outer circumferential portion 31. The winding adjustment operation can be performed by holding, for example, a side edge portion of a wound portion that is the farthest from the outer circumferential portion 31. This will be described using FIG. 7(*d*). If the first wound portion r1 is unwound by holding a side edge portion of the first wound portion r1, the second wound portion r2 and the third wound portion r3 are unwound accordingly. Thus, the roll diameters of the first to third wound portions r1, r2, and r3 can be made closer to the roll diameter of the outer circumferential portion 31. Alternatively, the winding adjustment operation can also be performed by holding a side edge portion of each wound portion in the center-side portion, and in this case, it is possible to make a fine adjustment of the roll diameter of each wound portion. With such a straightforward winding adjustment operation, the roll diameters of the wound portions of the lock of hair H in the tubular body 2 can be made substantially uniform, and the lock of hair H can be finished into an even neater spiral shape. Note that the procedures may also be advanced to the next curling treatment step without performing the winding adjustment operation in the deforming step.

In the curling treatment step, a curling treatment is performed on the lock of hair while maintaining the spiral form of the tubular body. In this step, the tubular body is kept in the spiral form using the above-described fixing member. When the tubular body is kept in the spiral form, the lock of hair, which is held in the tubular body, is also maintained in a spiral form. The curling treatment of the lock of hair is performed in this state. The curling treatment is a treatment for imparting a spiral shape to the lock of hair, and examples thereof include: a treatment of allowing the tubular body in the spiral form to stand for a predetermined period of time; a treatment of heating the tubular body; and a treatment that of applying a hair treatment agent such as a permanent wave agent to the lock of hair through the slits.

Figure 8A:
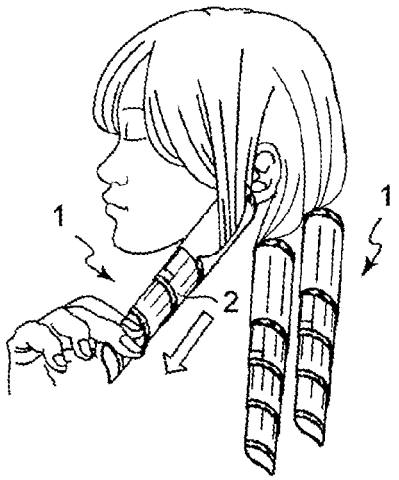
FIGS. 8(*a*) and 8(*b*) are schematic diagrams showing respective states in which the curling treatment illustrated in FIG. 7 is being performed and has been performed on head hair.
Figure 8B:
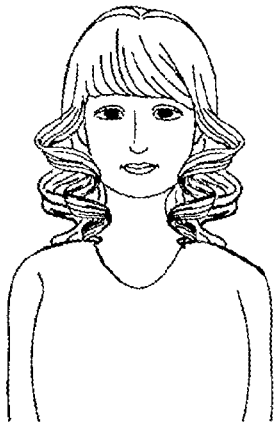

The curling treatment step is completed by removing the lock of hair from the tubular body as illustrated in FIG. 8(*a*). The lock of hair removed from the tubular body has a spiral shape such as that illustrated in FIG. 8(*b*), for example. After the curling treatment step, the lock of hair that has been curled may be subjected to a post-treatment, if necessary. As the post-treatment, washing hair, drying hair using a drying means such as a dryer, applying a hair treatment agent to hair, and other treatments can be performed alone or in a combination of two or more. Examples of the hair treatment agent that may be used in the post-treatment include a hair conditioning agent, a pre-hair-conditioning agent, a styling agent, a hair tonic agent, a hair restoration and hair growth agent, and the like.

According to the hair treatment method of the present embodiment, the lock of hair can be set in a spiral form by pulling out the center-side portion of the lock-of-hair holding body toward the lateral side of the lock-of-hair holding body. Furthermore, the operation of winding the lock of hair into a spiral is straightforward, and fine adjustment of the roll diameter of the spiral can be easily performed.

According to the hair treatment method of the present embodiment, the lock of hair may be partially curled, or the lock of hair may be entirely curled. In the case where the lock of hair is to be partially curled, a portion between roots and hair ends of the lock of hair, or more specifically, for example, a root portion, a hair tip portion that contains hair ends, or an intermediate portion between the root portion and the hair tip portion may be curled.

From the viewpoint of effectively performing the curling treatment, in the hair treatment method of the present embodiment, it is preferable to perform the curling treatment on a lock of hair in a wet state. In the case where the curling treatment is to be performed on a lock of hair in a wet state, the lock of hair is made wet at a stage preferably prior to the rolling-up step, or more preferably prior to the insertion step. The "wet state" as used herein means a state in which the surfaces of hairs of the lock of hair are moistened or wetted by applying water or a hair treatment agent such as a styling agent to the lock of hair. A commonly commercially available hair treatment agent can be used as the hair treatment agent such as the styling agent. The method for making the lock of hair wet is not limited to a specific method, and examples thereof include a method of spraying water or a hair treatment agent such as a styling agent onto the lock of hair using a spray or the like and a method of pouring running water over the lock of hair using a shower or the like. Moreover, it is also possible to wash hair prior to the insertion step and perform the hair treatment method in a state in which the hair is not dried or is semi-dried. Alternatively, the lock of hair may also be made wet after the insertion step, or after the rolling-up step, by applying water or a hair treatment agent to the lock of hair in the tubular body via the slits of the hair holder. In other words, the curling treatment of the lock of hair may be performed in a state in which the lock of hair has been made wet at any of the stages prior to inserting the lock of hair into the tubular body 2, after inserting the lock of hair into the tubular body 2, or after rolling up the tubular body 2.

Now, materials for forming the various portions of the hair holder will be described.

As the material for forming a sheet the constitutes the tubular body, for example, a nonwoven fabric (a polyethylene nonwoven fabric, a polyethylene terephthalate nonwoven fabric, or the like), a woven fabric, a net-like sheet, a porous or non-porous resin film (a polyethylene film, a polyethylene terephthalate film, or the like), paper, a polymer material sheet, a rubber sheet, a composite of these materials, or the like may be used.

The thicknesses of the first surface sheet and the second surface sheet are preferably 5 μm or greater and more preferably 10 pm or greater, is preferably 2,000 μm or less and more preferably 1,500 μm or less, and is preferably from 5 to 2,000 μm and more preferably from 10 to 1,500 μm.

Preferably, a sheet that constitutes the tubular body is subjected to processing for improving the diffusibility of a hair treatment agent such as a permanent wave agent. Examples of this processing include, but are not limited to, embossing, calendering, resin film formation, and the like. For example, the embossing can improve the diffusibility by forming protrusions successively arranged in the longitudinal direction of the sheet and thereby allowing the hair treatment agent to flow along the protrusions. The calendering can improve the diffusibility of the hair treatment agent by adjusting the density of the sheet that constitutes the tubular body. The resin film formation can improve the diffusibility of the hair treatment agent by forming a resin film with low liquid absorbency partially or entirely on the sheet that constitutes the tubular body and thereby reducing the total liquid absorption amount of the sheet.

A method for producing the hair holder will be described. The tubular body of the hair holder can be formed by superposing two sheets one on top of the other and integrating side portions of the two sheets along their longitudinal direction. Alternatively, the tubular body of the hair holder can be formed by folding a single sheet into a rectangular shape in a plan view, and integrating side portions of the sheet that extend along its longitudinal direction and overlap each other. A sheet for forming the tubular body can be produced from a raw material sheet by punching the raw material sheet into a predetermined shape.

Examples of the method for integrating the sheets for forming the tubular body, that is, the method for forming the pair of side joint portions 24 include: fusion bonding such as heat sealing or ultrasonic sealing; adhesion using an adhesive or the like; and sewing.

The first and second members, which constitute the fixing member, can be provided on the tubular body by integrating these members with the sheets that form the tubular body. In this case, for example, the first member 5*a* is integrated with the first surface sheet 23A, and furthermore, the second members 5*b* are integrated with the second surface sheet 23B. Examples of the method for integrating the fixing member with the sheets that form the tubular body include: fusion bonding such as heat sealing or ultrasonic sealing; adhesion using an adhesive or the like; and sewing.

The hair holder of the present invention is not limited to the foregoing embodiments, and appropriate changes can be made thereto without departing from the gist of the present invention.

For example, the shape and the surface of a sheet material that constitutes the "tubular body 2" may be a surface that has protrusions and depressions or may be a flat surface.

The present invention further discloses the following hair holders and methods for producing the same.

<1>

A hair holder including a tubular body and a fixing member, the tubular body having: a first opening located at a first end; and a second opening located at a second end, and being configured to allow a lock of hair to be inserted from the first opening toward the second opening and to be capable of being rolled up, and the fixing member maintaining a state in which the tubular body is rolled up, wherein the tubular body has a longitudinal direction and a width direction that is orthogonal to the longitudinal direction, and has a first surface sheet and a second surface sheet, and when the tubular body is rolled up, the first surface sheet is located on the inside of the tubular body and the second surface sheet is located on the outside of the tubular body, the second surface sheet has a plurality of slits that extend in the width direction and that are intermittently arranged along the longitudinal direction, the fixing member has a first member and second members that can be detachably joined together, the first member is arranged on the first surface sheet on the side of the first opening in the longitudinal direction, the second surface sheet has a central region in the width direction where the plurality of slits are provided and a pair of side regions each of which is located on opposite sides of the central region, and the second members are arranged in the pair of side regions, respectively, so as to extend in the longitudinal direction.

<2>

The hair holder as set forth in clause <1>, wherein the first member is a male member of a mechanical hook-and-loop fastener, and the second members are female members of the mechanical hook-and-loop fastener.

<3>

The hair holder as set forth in clause <1> or <2>, wherein the second members are arranged so as to overlap end portions of the slits.

<4>

The hair holder as set forth in any one of clauses <1> to <3>, wherein the slits each have circular portions at both end portions thereof.

<5>

The hair holder as set forth in any one of clauses <1> to <4>, wherein a length W12 in the width direction of a portion of each of the second members, the portion being present in a corresponding one of the side regions, is 50% or greater and preferably 70% or greater, is 100% or less and preferably 90% or less, and is from 50% to 100% and preferably from 70% to 90% of a length W10 of that second member in the width direction.

<6>

The hair holder as set forth in any one of clauses <1> to <5>, wherein a length L5 of the second members in the longitudinal direction is 10% or greater and preferably 20% or greater, is 100% or less and preferably 90% or less, and is from 10% to 100% and preferably from 20% to 90% of a length L2 of the tubular body in the longitudinal direction.

<7>

The hair holder as set forth in any one of clauses <1> to <5>, wherein the second members are disposed within a range of 0% to 90%, preferably 5% to 85%, and more preferably 10% to 80% of a length L2 of the tubular body in the longitudinal direction from the first opening in the longitudinal direction.

<8>

The hair holder as set forth in any one of clauses <1> to <7>, wherein the first member has a shape that is elongated in the width direction.

<9>

The hair holder as set forth in any one of clauses <1> to <8>, wherein a length of the first member in the width direction is from 70% to 100% of a length of the tubular body in the width direction.

<10>

The hair holder as set forth in any one of clauses <1> to <9>, wherein a length of the first member in the width direction is 70% or greater and preferably 80% or greater, is 100% or less and preferably 95% or less, and is from 70% to 100% and preferably from 80% to 95% of a length of the tubular body in the width direction.

<11>

The hair holder as set forth in any one of clauses <1> to <10>, wherein the first surface sheet has an extended portion that extends longitudinally outward from the tubular body.

<12>

The hair holder as set forth in any one of clauses <1> to <11>, wherein the first surface sheet has the extended portion on the first opening side of the tubular body.

<13>

The hair holder as set forth in any one of clauses <1> to <12>, wherein the extended portion is formed integrally with the first surface sheet.

<14>

The hair holder as set forth in any one of clauses <1> to <13>, wherein the first member is located on an outer surface side of the extended portion.

<15>

The hair holder as set forth in any one of clauses <1> to <14>, wherein the second members are located on an outer surface side of the second surface sheet.

<16>

The hair holder as set forth in any one of clauses <1> to <15>, wherein the tubular body has: a pair of side joint portions where the first surface sheet and the second surface sheet are joined to each other; and a tubular portion that is located between the pair of side joint portions, and the tubular portion has a space which is located between the first opening and the second opening in the longitudinal direction and into which the lock of hair can be inserted.

<17>

The hair holder as set forth in clause <16>, including a reinforcement material in the side joint portions.

<18>

The hair holder as set forth in clause <16> or <17>, wherein the second members are arranged at positions that do not overlap the side joint portions.

<19>

The hair holder as set forth in any one of clauses <1> to <18>, including winding and tightening tabs on opposite side edge portions, respectively, of the tubular body, the side edge portions extending in the longitudinal direction.

<20>

The hair holder as set forth in any one of clauses <1> to <19>, wherein a length W2 of the tubular body in the width direction is 25 mm or greater and preferably 30 mm or greater, is 200 mm or less and preferably 150 mm or less, and is from 25 to 200 mm and preferably from 30 to 150 mm.

<21>

The hair holder as set forth in any one of clauses <1> to <20>, wherein a length L1 of the hair holder in the longitudinal direction is 50 mm or greater and preferably 100 mm or greater, is 400 mm or less and preferably 350 mm or less, and is from 50 to 400 mm and preferably from 100 to 350 mm.

<22>

The hair holder as set forth in any one of clauses <1> to <21>, wherein a length L2 of the tubular body in the longitudinal direction is 45 mm or greater and preferably 90 mm or greater, is 300 mm or less and preferably 275 mm or less, and is from 45 to 300 mm and preferably from 90 to 275 mm.

<23>

The hair holder as set forth in any one of clauses <1> to <22>, wherein a length W22 of the second opening in the width direction is 40.0% or greater and preferably 66.7% or greater, is 97.5% or less and preferably 96.7% or less, and is from 40.0% to 97.5% and preferably from 66.7% to 96.7% of a length W2 of the tubular body in the width direction.

<24>

The hair holder as set forth in any one of clauses <1> to <23>, wherein a length W22 of the second opening in the width direction is 10 mm or greater and preferably 20 mm or greater, is 195 mm or less and preferably 145 mm or less, and is from 10 to 195 mm and preferably from 20 to 145 mm.

<25>

The hair holder as set forth in any one of clauses <1> to <24>, wherein a length W6 of the slits in the width direction is 40.0% or greater and preferably 50.0% or greater, is 90.0% or less and preferably 80.0% or less, and is from 40.0% to 90.0% and preferably from 50.0% to 80.0% of a length W2 of the tubular body in the width direction.

<26>

The hair holder as set forth in any one of clauses <1> to <25>, wherein a length W6 of the slits in the width direction is 10 mm or greater and preferably 15 mm or greater, is 180 mm or less and preferably 120 mm or less, and is from 10 to 180 mm and preferably from 15 to 120 mm.

<27>

A method for producing the hair holder as set forth in any one of clauses <1> to <26>, wherein the second members and the second surface sheet are integrated by fusion bonding.

<28>

A method for producing the hair holder as set forth in any one of clauses <1> to <26>, wherein the second members and the second surface sheet are integrated by adhesion.

<29>

A method for producing the hair holder as set forth in any one of clauses <1> to <26>, wherein the second members and the second surface sheet are integrated by sewing.

<30>

Use of the hair holder as set forth in any one of clauses <1> to <29>, including inserting a lock of hair into the tubular body, rolling up the tubular body, and performing a curling treatment on the lock of hair.

<31>

The use of the hair holder as set forth in clause <30>, wherein the curling treatment of the lock of hair is performed in a state in which the lock of hair has been made wet at any of stages prior to inserting the lock of hair into the tubular body, after inserting the lock of hair into the tubular body, or after rolling up the tubular body.

INDUSTRIAL APPLICABILITY

According to the present invention, there are provided a hair holder that facilitates the application of a hair treatment agent such as a perming fluid to a lock of hair, that restrains concentration of stress in end portions of slits when releasing a tubular body from a wound state, and that has a high degree of freedom in terms of shape that can be imparted to the lock of hair, a method for producing the hair holder, and use of the hair holder.

The invention claimed is:

1. A hair holder comprising a tubular body and a fixing member, the tubular body having: a first opening located at a first end; and a second opening located at a second end, and being configured to allow a lock of hair to be inserted from the first opening toward the second opening and to be capable of being rolled up, and the fixing member maintaining a state in which the tubular body is in a rolled up configuration, wherein the tubular body has a longitudinal direction and a width direction that is orthogonal to the longitudinal direction, and has a first surface sheet and a second surface sheet, and when the tubular body is in said rolled up configuration, the first surface sheet is located on the inside of the tubular body and the second surface sheet is located on the outside of the tubular body, the tubular body has: a pair of side joint portions where the first surface sheet and the second surface sheet are joined to each other; and a tubular portion that is located between the pair of side joint portions, the second surface sheet has a plurality of slits that extends in the width direction and that is intermittently located along the longitudinal direction, the fixing member has a first member and second members that can be detachably joined together, the first member is located on the first surface sheet on the opposite side of the first opening in the width direction, the second surface sheet has a central region in the width direction, where the plurality of slits is provided, and a pair of side regions each of which is located on opposite sides of the central region, the second members are located in the pair of side regions, respectively, and extend in the longitudinal direction, and the first member is located between the pair of side regions through the central region, and wherein the second members are located at positions that do not overlap the side joint portions.

2. The hair holder according to claim 1, wherein the first member is a male member of a mechanical hook-and-loop fastener, and the second members are female members of the mechanical hook-and-loop fastener.

3. The hair holder according to claim 1, wherein the second members are arranged so as to overlap end portions of the plurality of slits.

4. The hair holder according to claim 1, wherein the slits have circular portions at both end portions thereof.

5. The hair holder according to claim 1, wherein the first surface sheet has an extended portion that extends longitudinally outward from the tubular body.

6. The hair holder according to claim 5, wherein the first surface sheet has the extended portion on the first opening side of the tubular body.

7. The hair holder according to claim 5, wherein the extended portion is formed integrally with the first surface sheet.

8. The hair holder according to claim 5, wherein the first member is located on an outer surface side of the extended portion.

9. The hair holder according to claim 1, wherein the second members are located on an outer surface side of the second surface sheet.

10. The hair holder according to claim 1, comprising a reinforcement material in the side joint portions.

11. The hair holder according to claim 1, comprising winding and tightening tabs on opposite side edge portions, respectively, of the tubular body, the side edge portions extending in the longitudinal direction.

12. A method for curling a lock of hair by using the hair holder according to claim 1, comprising inserting a lock of hair into the tubular body, rolling up the tubular body, and performing a curling treatment on the lock of hair.

13. The method for curling a lock of hair according to claim 12, wherein the curling treatment of the lock of hair is performed in a state in which the lock of hair has been made wet at any of stages prior to inserting the lock of hair into the tubular body, after inserting the lock of hair into the tubular body, or after rolling up the tubular body.

14. The hair holder according to claim 1, wherein the second members are not arranged in a middle portion of the tubular body in the width direction.

15. The hair holder according to claim 1, wherein the tubular body can be deformed into a spiral shape.

16. The hair holder according to claim 1, wherein the first surface sheet has an extended portion that extends longitudinally outward from the tubular body, the first member is located on an outer surface side of the extended portion and extends in the width direction, a length of the first member in the width direction is from 70% to 100% of a length of the tubular body in the width direction, and the second members are located in the tubular portion in the pair of side regions, respectively, and located inward in the width direction than the pair of side joint portions, respectively.

17. The hair holder according to claim 1, wherein each of the side joint portions comprise a reinforcement material in the side joint portions located on the outer surface of the second sheet.

* * * * *